US006655278B2

(12) United States Patent
Kawabata

(10) Patent No.: US 6,655,278 B2
(45) Date of Patent: Dec. 2, 2003

(54) APPARATUS FOR FINE POSITIONAL ADJUSTMENT OF A PLATE CYLINDER FOR MULTICOLOR IMAGE REGISTRATION

(75) Inventor: Takanobu Kawabata, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 170 days.

(21) Appl. No.: 09/859,486

(22) Filed: May 18, 2001

(65) Prior Publication Data

US 2001/0050013 A1 Dec. 13, 2001

(51) Int. Cl.[7] ..... B41F 13/24; B41F 5/18; B41L 47/14; B41B 11/00

(52) U.S. Cl. ..... 101/248; 101/477; 101/480; 101/485; 101/180; 101/181; 101/183; 33/618; 33/614

(58) Field of Search ..... 101/248, 378, 101/383, 388, 477, 480, 485, 180, 181, 183, 486, DIG. 36; 33/614, 618, 621

(56) References Cited

U.S. PATENT DOCUMENTS 5,327,829 A * 7/1994 Miyoshi et al. ..... 101/177
5,419,248 A * 5/1995 Brotzman ..... 101/378
6,192,793 B1 * 2/2001 Motoe et al. ..... 101/116

FOREIGN PATENT DOCUMENTS

JP 53-134507 11/1978
JP 63-91248 4/1988

* cited by examiner

*Primary Examiner*—John S. Hilten
*Assistant Examiner*—Marvin P Crenshaw
(74) *Attorney, Agent, or Firm*—Rader, Fishman & Grauer PLLC

(57) ABSTRACT

An apparatus for positional adjustment of a plate cylinder in both lateral and circumferential directions thereof for image registration in a multicolor, offset rotary printing press. A lateral adjustment mechanism includes a spur gear which is motor driven bidirectionally, and which travels laterally back and forth, to cause lateral displacement of the plate cylinder. The gear has a pin erected eccentrically thereon for abutment against a fixed limit stop on the press frame in order to limit the bidirectional rotation of the gear and hence to prevent the plate cylinder from being driven laterally beyond limits. A circumferential adjustment mechanism includes another spur gear which is motor driven bidirectionally, and which also travels laterally back and forth, to cause circumferential displacement of the plate cylinder. This second gear has a double-ended pin extending eccentrically therethrough and having its ends projecting in opposite directions therefrom. The double-ended pin is to hit a pair of limit stops on the press frame, which are spaced from each other laterally of the gear, in the event of bidirectional circumferential displacement of the plate cylinder beyond limits.

12 Claims, 5 Drawing Sheets

APPARATUS FOR FINE POSITIONAL ADJUSTMENT OF A PLATE CYLINDER FOR MULTICOLOR IMAGE REGISTRATION

BACKGROUND OF THE INVENTION

This invention relates to printing presses in general and, in particular, to a multicolor, rotary printing press comprising a plurality of plate cylinders for printing as many different color images on a continuous web of paper. More particularly, the invention pertains to means in such a printing press for fine positional readjustment of each plate cylinder in both lateral (axial) and circumferential directions thereof for exact registration of the images with a reference image printed by one of the plate cylinders.

A variety of approaches have been made for printing in exact registration of multicolor images by a rotary printing press. Of such conventional efforts, one that is most pertinent to the instant invention is that disclosed in Japanese Unexamined Patent Publication No. 53-134507. The plate cylinder according to this prior art device is split into two halves along a plane at right angles with the cylinder axis, one of the cylinder halves being movable both laterally (axially) and circumferentially relative to the other. The split plate cylinder is provided, at each of its opposite ends, with a lateral adjustment and a circumferential adjustment whereby each cylinder half is positionally adjustable independently, even during printing.

Each lateral adjustment of the noted unexamined patent publication includes a screw-threaded rod which is coaxially and rotatably coupled to each lateral end of the plate cylinder while being restrained from lateral displacement relative to the same. The threaded rod is matingly engaged with an internally threaded sleeve which is rotatably mounted to the frame while being locked against lateral displacement relative to the same. Thus, as the threaded sleeve is driven bidirectionally, the threaded rod travels back and forth with one of the plate cylinder halves for readjustment of its lateral position.

Each circumferential adjustment, on the other hand, of the same prior art device includes another sleeve which is fitted over one end portion of the plate cylinder shaft for relative displacement in its lateral direction only. One end of the sleeve is coaxially joined to a helical gear which is in mesh with another such gear on the neighboring blanket cylinder. Also coupled to the sleeve is a spur gear which is rotatable relative to the sleeve but which is locked against lateral displacement relative to the same. This spur gear is coaxially provided with an externally threaded boss which is engaged with an internally threaded member mounted fast to the frame.

Therefore, on being driven angularly bidirectionally, the spur gear laterally travels back and forth with the sleeve on the plate cylinder shaft because of the mating engagement of its threaded boss with the fixed, internally threaded member. Traveling laterally, moreover, the sleeve is forced to make angular displacement with the plate cylinder shaft as the helical gear thereon slides in mating engagement with the similar gear on the blanket cylinder. The plate cylinder half is thus readjusted in its circumferential position.

Another similar register control device is found in Japanese Unexamined Patent Publication No. 63-91248. This second prior art device also has a sleeve which is formed in one piece with a helical gear for driving the plate cylinder and which is rotatably coupled to the plate cylinder shaft while being restrained from lateral displacement relative to the same. The sleeve is externally threaded for mating engagement with an internally threaded member affixed to the frame and carries on its end away from the helical gear a pinion in engagement with a rack for lateral adjustment.

The circumferential adjustment of this second prior art device has a second sleeve fitted over the first mentioned sleeve and screw-threadedly engaged therewith. The second sleeve has one end thereof rotatably coupled to the helical gear and restrained from lateral displacement relative to the same. The other end of the second sleeve is shaped into a pinion engaging with another rack for circumferential adjustment.

Both prior art devices are alike in having gears or toothed wheels driven by rotary or linear actuators. Mechanically farthest away from the plate cylinder shaft to be driven, these drive wheels are threadedly engaged with sleeves or the like in order to enable translation from rotary to linear motion. The linear motion is imparted more or less directly to the plate cylinder for its lateral displacement and, for circumferential displacement, reconverted into rotary motion by the relative sliding motion of the intermeshing helical gears through which the plate cylinder is driven during printing.

Typically, in offset rotary printing presses for newspaper production, the maximum allowable lateral displacement of the drive wheels for lateral adjustment is set in a range of four to six millimeters, and that of the drive wheels for circumferential adjustment in a range of twelve to eighteen millimeters. In practice, however, the drive wheels have often been driven in excess of these limits as the rotary or linear actuators are left in operation for prolonged periods of time due to some errors in control or in manual operation.

One frequent result of such overdriving has been the riding of the drive wheels onto the incomplete threads of the rods or the sleeves, with the consequent jamming of the adjustments. Some movable parts of the adjustments have also been easy to run into some other parts with which they should be totally out of contact, again resulting in jamming and, in the worst case, in the irreparable damage of these parts.

It has often been impossible to recover, for instance, the drive wheels back from the incomplete threads merely by reversing the actuators. Prolonged periods of time have thus had to be expended for recovery from such troubles, adding very substantially to the downtime, as well as the maintenance costs, of the multicolor printing press. Obviously, moreover, the useful life of the press must also have been considerably curtailed.

SUMMARY OF THE INVENTION

The present invention seeks totally to preclude the overrunning of both lateral and circumferential adjustments incorporated in a multicolor printing press for image registration purposes, thereby enhancing reliability in the operation of the adjustments, reducing the downtime of the machine, and extending its useful life.

Briefly, the invention may be summarized as an apparatus for fine positional adjustment of a plate cylinder in both lateral and circumferential directions thereof for image registration of a multicolor rotary printing press. Included is a plate cylinder supported by frame means for both lateral and circumferential displacement. Lateral adjustment means act between the plate cylinder and the frame means for positional adjustment of the plate cylinder in a lateral direction thereof relative to the frame means. Circumferential adjustment means also act between the plate cylinder and the frame means for positional adjustment of the plate cylinder in a circumferential direction thereof relative to the frame means.

The invention particularly features lateral overrun prevention means for limiting the bidirectional rotation of a first rotary member of the lateral adjustment means relative to the frame means in order to prevent the plate cylinder from being driven laterally beyond limits, and circumferential overrun prevention means for limiting the bidirectional rotation of a second rotary member of the circumferential adjustment means relative to the frame means in order to prevent the plate cylinder from being driven circumferentially beyond limits.

In a preferred embodiment both first and second rotary members take the form of driven gears, which are in mesh with drive pinions on the output shafts of lateral and circumferential drive motors, respectively. Locking the driven gears against rotation in the event of an emergency, rather than other rotary or movable parts of the lateral and the circumferential adjustment means, is preferred because the driven gears can be easily made large enough to be arrested lightly.

Adapted for this embodiment, the lateral overrun prevention means comprises a limit stop formed on the frame means, and a projection formed eccentrically on the driven gear of the lateral adjustment means for movement into abutment against the limit stop with the prolonged rotation of the driven gear. Preferably, normally positioned at an angular distance of approximately 180 degrees from the limit stop, the projection is to travel, with the bidirectional rotation of the driven gear, into possible abutment against the opposite sides of the limit stop.

The circumferential adjustment means likewise comprises limit stop means on the frame means, and projection means formed eccentrically on the driven gear of the circumferential adjustment means for movement into abutment against the limit stop with the prolonged rotation of the driven gear. Since the driven gear not only rotates but travels laterally for circumferential positioning of the plate cylinder, the limit stop means may have a pair of limit stops spaced from each other laterally of the driven gear. The projection means may have a pair of projections formed on opposite sides of the driven gear for movement, with the combined bidirectional rotary and lateral motion of the driven gear, into abutment against the respective limit stops.

Thus, with the driven gears of both lateral and circumferential adjustment means positively restrained from rotation beyond limits, no undue displacement of the plate cylinder is to take place in either its lateral or circumferential direction. Moreover, when either or both of the driven gears are locked against rotation by the overrun prevention means, no damaging force will be exerted on any parts of the adjustment means or on any associated parts of the press.

It is also preferred that both lateral and circumferential adjustment means include drive means such as rotary or linear actuators having their output forces optimally preadjusted in order to avoid damage upon functioning of the overrun prevention means. Stepper motors are particularly recommendable as they suffer no damage at all, mechanically or electrically, when forced to stop.

Altogether, the multicolor printing press built on the novel concepts of the invention will drastically reduce both downtime and operating hours per unit volume of production. These results will be of particular advantage in newspaper production which is hard pressed for time.

The above and other objects, features and advantages of the invention and the manner of realizing them will become more apparent, and the invention itself will best be understood, from the following description taken together with the attached drawings showing some preferred embodiments of the invention.

DESCRIPTION OF THE PREFERRED EMBODIMENT

General

The present invention will now be described in detail as applied to a multicolor offset rotary printing press having a plurality of printing units, each conventionally comprising a plate cylinder, a blanket cylinder, an impression cylinder and so forth, for printing multicolor images on a continuous web of paper traveling therethrough. The invention concerns how to support each such plate cylinder so as to permit fine positional adjustment thereof in both lateral and circumferential directions so that the multicolor images may be printed in exact register with each other.

Figure 1:
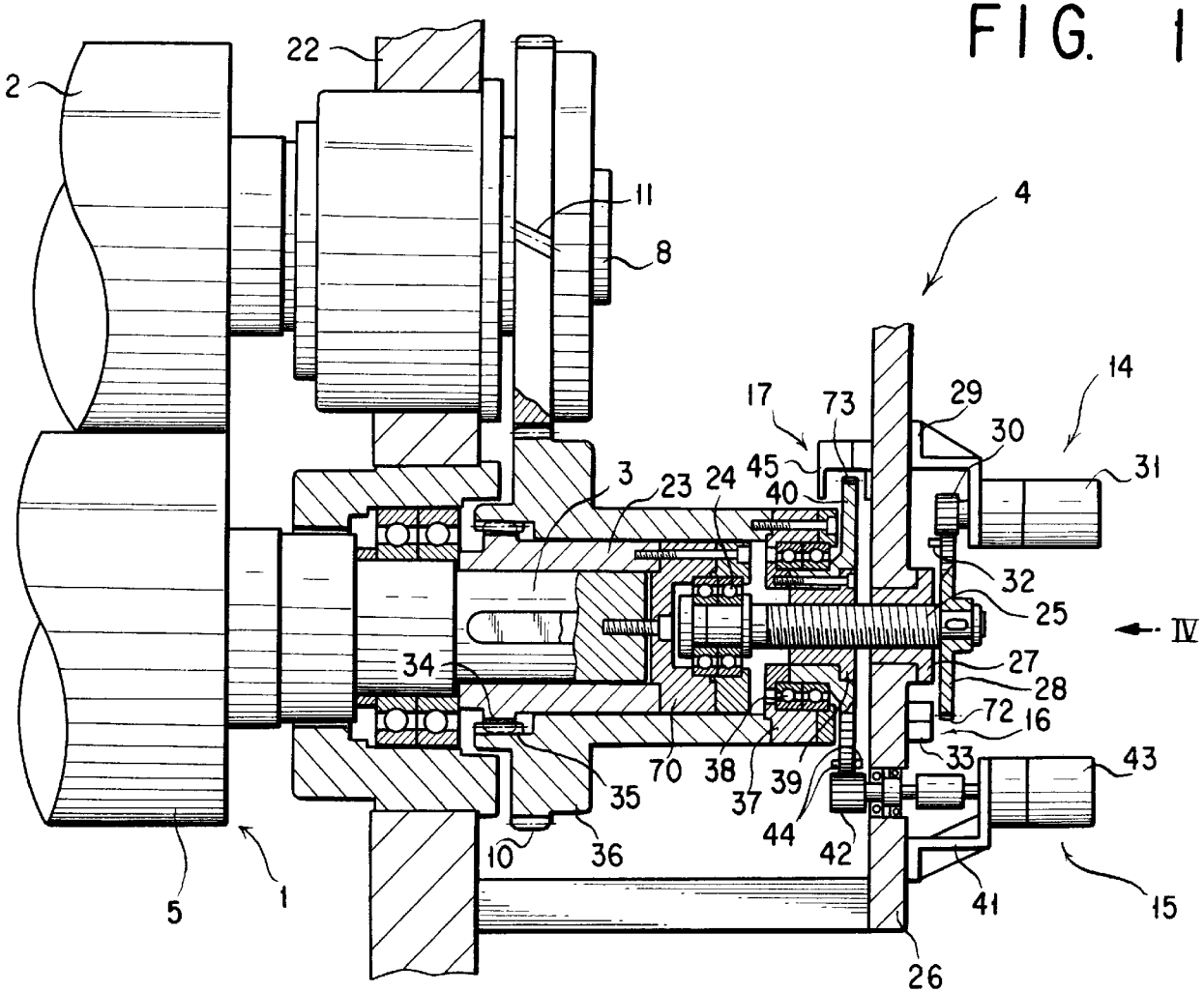
FIG. 1 is an axial sectional view showing how one end of a plate cylinder of a rotary offset printing press, which cylinder has its plate-carrying surface split into a pair of halves along a plane normal to its axis, is supported and coupled to lateral and circumferential adjustments according to the invention.
Figure 2:
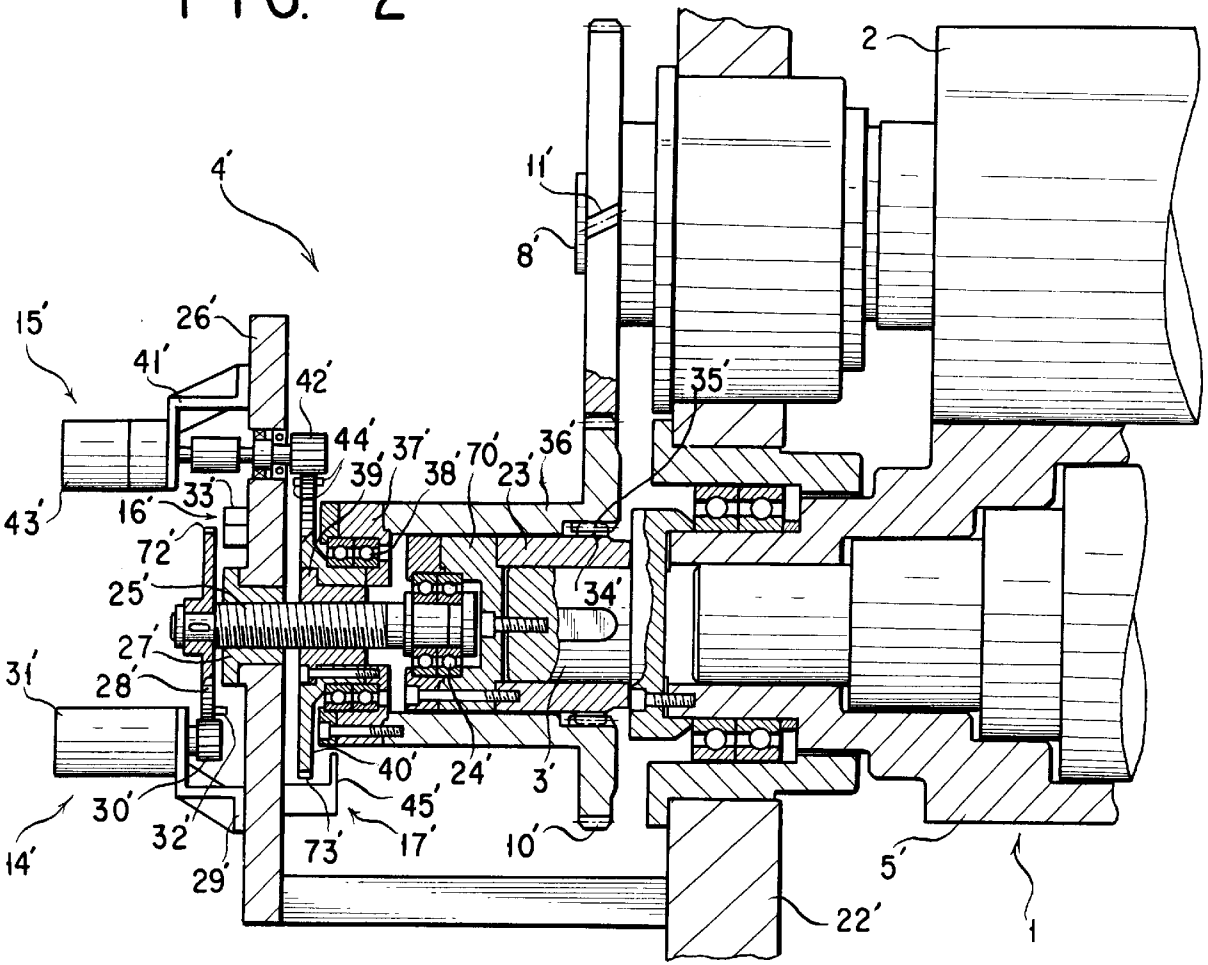
FIG. 2 is a view similar to FIG. 1 but showing how the other end of the plate cylinder is supported and coupled to its own lateral and circumferential adjustments according to the invention.

FIGS. 1 and 2 depict one such plate cylinder 1, as well as one associated blanket cylinder 2, both supported between a pair of confronting frame walls 22 and 22' for both lateral and circumferential displacement. The two cylinders 1 and 2 are coupled together via two intermeshing helical gears 10 and 11, FIG. 1, and another two similar gears 10' and 11', FIG. 2, for joint rotation during printing, although these helical gears are additionally utilized for circumferential positional adjustment of the plate cylinder.

Figure 3:
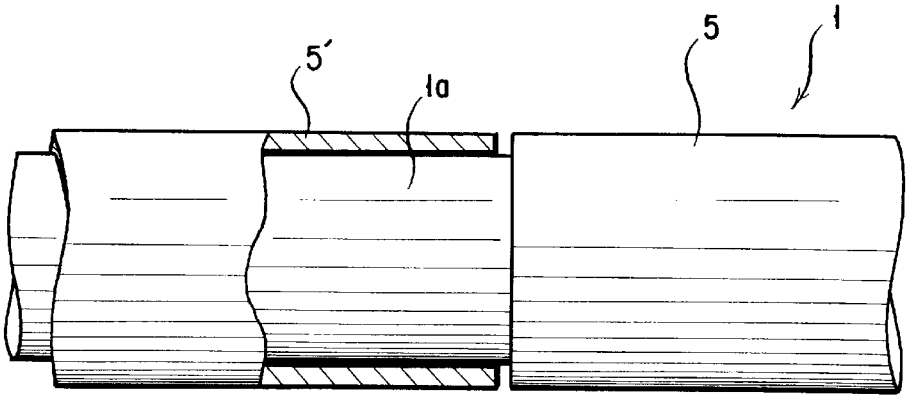
FIG. 3 is a fragmentary elevation, with a part shown broken away to reveal another part, of the split plate cylinder of FIGS. 1 and 2.

As shown fragmentarily in FIG. 3, the plate cylinder 1 has its plate-carrying surface-split into a pair of halves 5 and 5' in this particular embodiment of the invention. The plate cylinder half 5' is slidably fitted over the reduced diameter portion 1*a* of the plate cylinder which is in one piece with the other cylinder half 5. Separately carrying printing plates, not shown, both plate cylinder halves 5 and 5' are to be independently positionally adjusted in both lateral and circumferential directions thereof.

Thus, referring back to FIG. 1, the plate cylinder 1 is provided at its right hand end, as seen in this figure, with image registration means 4 for lateral and circumferential positional adjustment of the right hand plate cylinder half 5. At the left hand end of the plate cylinder 1, on the other hand, there are provided image registration means 4', FIG. 2, for lateral and circumferential positional adjustment of the left hand plate cylinder half 5'. Both image registration means 4 and 4' are alike in construction and operation.

The right hand image registration means 4 comprise a lateral adjustment 14 for lateral positional adjustment of the right hand plate cylinder half 5, and a circumferential adjustment 15 for circumferential positional adjustment of the same. The lateral adjustment 14 is provided with lateral overrun prevention means 16, and the circumferential adjustment 15 with circumferential overrun prevention means 17, in order to keep the respective adjustments 14 and 15 from jamming through accidental or inadvertent overdriving.

The left hand image registration means 4' likewise comprise a lateral adjustment 14' and a circumferential adjustment 15' for lateral and circumferential positional adjustment, respectively, of the left hand plate cylinder half 5'. The lateral adjustment 14' is provided with lateral overrun prevention means 16', and the circumferential adjustment 15' with circumferential overrun prevention means 17'.

Hereinafter in this specification the above noted lateral adjustment 14, lateral overrun prevention means 16, circumferential adjustment 15, and circumferential overrun prevention means 17 for the right hand plate cylinder half 5 will be discussed in more detail, under separate headings and in that order. The lateral adjustment 14', lateral overrun prevention means 16', circumferential adjustment 15', and circumferential overrun prevention means 17' for the left hand plate cylinder half 5' are substantially identical in construction with their right hand counterparts to be detailed, so that their description will be omitted, and their constituent parts will be identified in FIG. 2 merely by priming the reference numerals used to denote their corresponding parts in the right hand image registration means 4. Operational description of the complete apparatus will follow the discussion of the listed components.

Lateral Adjustment

With reference to FIG. 1 the lateral adjustment 14 as a whole is coupled to a reduced diameter extension 3 of the plate cylinder shaft which is journaled in the frame wall 22 for both angular and lateral displacement relative to the same. The lateral adjustment 14 includes an inner sleeve 23 fitted over the plate cylinder shaft extension 3 and restrained from both lateral and angular displacement relative to the same in a manner to be made apparent presently. A spur gear 34 is formed externally on part of the inner sleeve 23 for use as a part of the circumferential adjustment 15 yet to be detailed.

Having an antifriction bearing 24 mounted therein, a bearing housing 70 is coaxially mounted fast to the plate cylinder shaft extension 3 and fastened to the inner sleeve 23, locking the same against lateral and rotary motion relative to the plate cylinder shaft extension. A screw-threaded rod 25 is coaxially coupled to the plate cylinder shaft extension 3 by having its left hand end, as viewed in FIG. 1, journaled in the bearing 24 and is thereby constrained to lateral displacement with the plate cylinder shaft extension. There is no torque transmission, however, between plate cylinder shaft extension 3 and threaded rod 25.

The threaded rod 25 is screw-threadedly extended through a subframe wall 26 via a hollow, internally threaded member 27 mounted fast thereto, so that the threaded rod 25 will travel linearly back and forth relative to the subframe wall on being rotated bidirectionally. Preferably, the threaded rod 25 should be engaged with the internally threaded member 27 via antifriction balls, not shown, confined between their external and internal threads. Such balls will serve materially to reduce the frictional resistance to the required bidirectional rotation of the threaded rod 25.

On the right hand end, as seen in FIG. 1, of the threaded rod 25, projecting from the subframe wall 26, there is fixedly mounted a rotary member 28 which serves both for bidirectional torque transmission to the threaded rod and as a part of the lateral overrun prevention means 16. The rotary member 28 is herein shown as a driven gear, having a set of spur gear teeth 72 on its periphery. The driven gear 28 not only rotates with the threaded rod 25 but travels laterally therewith.

For the bidirectional rotation of the threaded rod 25 a lateral drive motor or actuator 31 is bracketed at 29 to the subframe wall 26. A preferred example of lateral drive motor 31 is a bidirectional stepper motor of prior art construction that rotates incrementally, rather than continuously, in response to electric stepping pulses. The stepper motor 31 has mounted on its output shaft a drive pinion 30 in mesh with the driven gear 28 on the threaded rod 25.

Lateral Overrun Prevention Means

Figure 4:
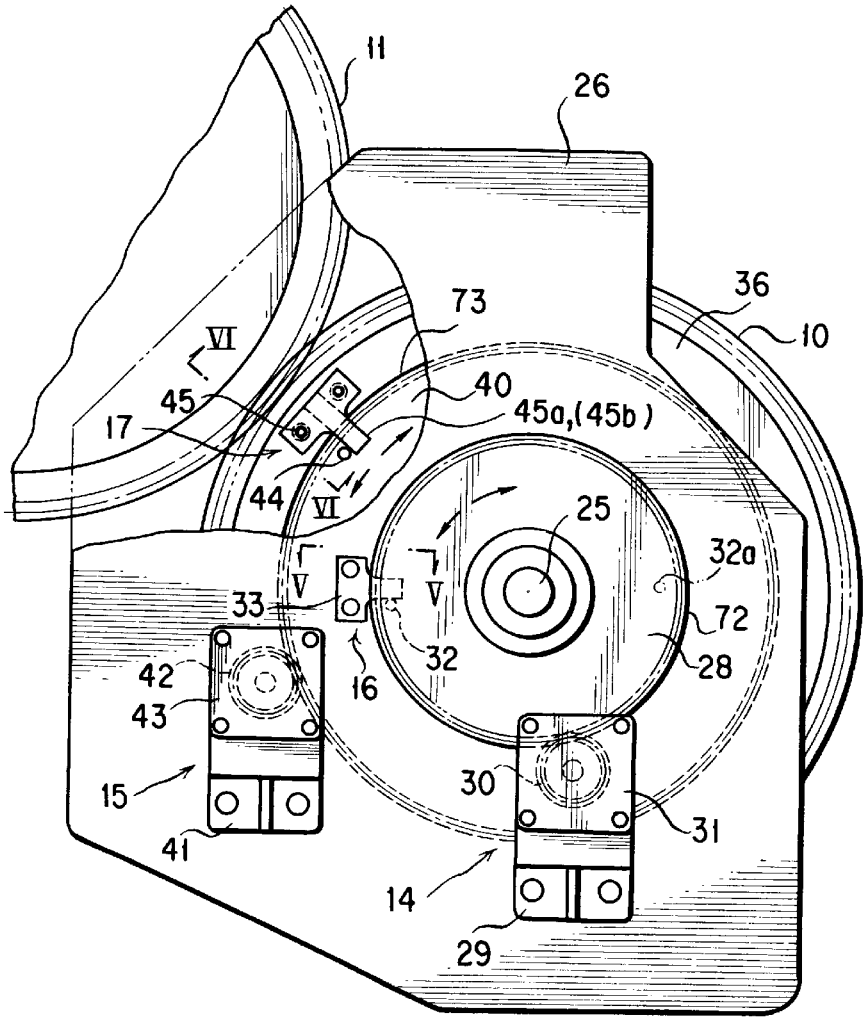
FIG. 4 is an enlarged end elevation, with a part shown broken away to reveal other parts, of the showing of FIG. 1, as seen in the direction of the arrow IV therein.
Figure 5A:
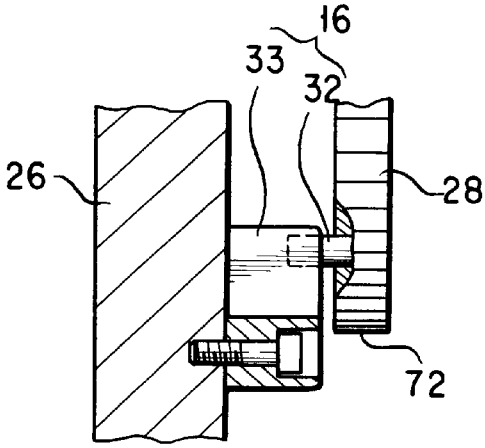
FIGS. 5A and 5B are a series of still more enlarged, fragmentary, sectional views explanatory of the operation of the lateral overrun prevention means of FIG. 1.
Figure 5B:
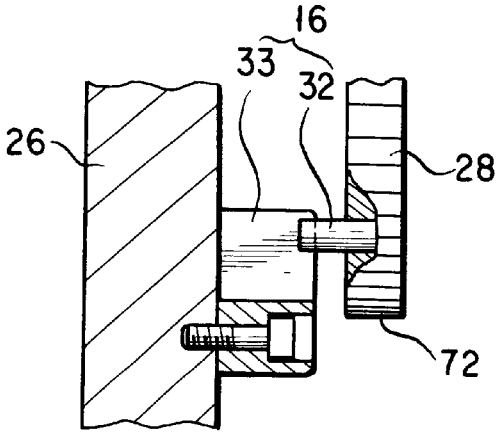

The lateral overrun prevention means 16 appearing in both FIGS. 1 and 4 and are shown on an enlarged scale in FIGS. 5A and 5B. Included is a pin or like projection 32 formed eccentrically on the driven gear 28 of the lateral adjustment 14 and extending toward the subframe wall 26. A limit stop 33 is fastened to the subframe wall 26, in a position to be hit by the pin 32 upon rotation of the driven gear 28 in excess of predetermined limits.

The plate cylinder 1, or its right hand half 5 to be more exact, is to be laterally displaced bidirectionally from its normal position. When the plate cylinder half 5 is in its normal lateral position, so is the driven gear 28 of the lateral adjustment 14 in its normal angular position, from which the driven gear is to be normally driven up to the same angle, which is less than 180 degrees, in either direction. When the driven gear 28 is in this normal angular position, the pin 32 is angularly spaced approximately 180 degrees from the limit stop 33, as indicated at 32*a* in FIG. 4.

Driven in either direction from this normal angular position 32*a* in excess of a predetermined limit, the pin 32 will come into abutment against either side of the limit stop 33 on the subframe wall 26. The pin 32 is shown engaging one side of the limit stop 33 in FIG. 5A and the other side of the limit stop in FIG. 5B. It will also be noted that the driven gear 28 differs in its lateral position between these two figures, since the driven gear travels laterally on angular displacement because of its mating engagement with the internally threaded member 27. The relative dimensions of the pin 32 and the limit stop 33 in a direction parallel to the driven gear axis must therefore be determined in consideration of the amount of lateral displacement made by the driven gear 28 upon 360 degrees rotation thereof.

Circumferential Adjustment

As shown also in FIG. 1, the circumferential adjustment 15 includes an outer sleeve 36 fitted over the inner sleeve 23 of the lateral adjustment 14 for lateral sliding motion relative to the inner sleeve. The outer sleeve 36 is formed in one piece with an internal spur gear 35 which is in mesh with the spur gear 34 in one piece with the inner sleeve 23. The outer sleeve 36 is therefore movable laterally relative to the inner sleeve 23 but is constrained to joint rotation therewith.

Also formed in one piece with the outer sleeve 36 is the aforesaid helical gear 10 in mesh with the other helical gear 11 on the blanket cylinder shaft 8. By virtue of these intermeshing helical gears 10 and 11 the outer sleeve 36 on bidirectional lateral displacement is to be angularly displaced in both directions with the inner sleeve 23, hence with the plate cylinder shaft extension 3, and hence with the right hand plate cylinder half 5.

The outer sleeve 36 has an antifriction bearing 38 mounted to its end away from the plate cylinder 1 via a bearing housing 37. Rotatably supported by this bearing is a rotary member 40 herein shown as a driven gear, carrying a set of spur gear teeth 73 on its periphery, to be driven bidirectionally from a circumferential drive motor or actuator 43 via a drive pinion 42. The driven gear 40 is coaxially mounted on the threaded rod 25, set forth in conjunction with the lateral adjustment 14, via a hollow, internally threaded member 39. This internally threaded member 39 is secured to the driven gear 40, substantially constituting an integral part of the gear. Thus the driven gear 40 not only rotates but travels laterally relative to the threaded rod 25. Because of the interposition of the bearing 38, however, it is only the lateral motion of the driven gear 40 that is transmitted to the outer sleeve 36 for circumferential positioning of the plate cylinder half 5.

The circumferential drive motor 43 is bracketed at 41 to the subframe wall 26. A preferred example of circumferential drive motor 43 is, again, a bidirectional stepper motor.

The stepper motors 31 and 43, both FIG. 1, of the right hand lateral and the circumferential adjustments 14 and 15, as well as the stepper motors 31' and 43', FIG. 2, of the left hand lateral and the circumferential adjustments 14' and 15' should all be of the known type that operate with a predetermined output torque and that stall without suffering any electrical or mechanical damage, when overloaded. Stepper motors of this type are available from various manufactures.

Other types of drive means could be employed, however, as long as they meet the foregoing requirements. Examples include hydraulic cylinders or hydraulic motors that operate with a hydraulic fluid under preset pressure, motors with a clutch such as a torque limiter that permits adjustment of a disconnection torque, and torque motors capable of electrical output torque control.

Circumferential Overrun Prevention Means

Figure 6A:
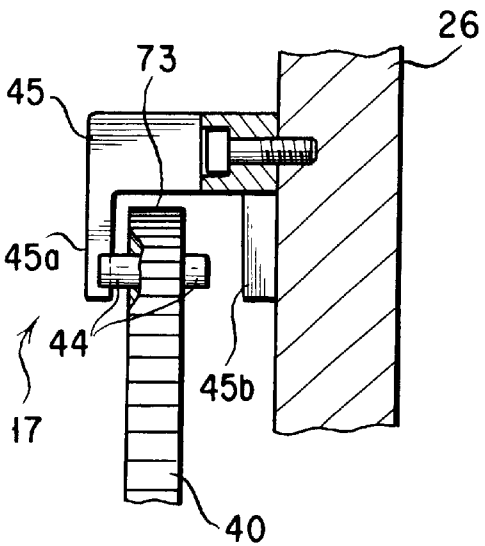
FIGS. 6A, 6B and 6C are a series of views similar to FIGS. 5A and 5B but explanatory of the operation of the circumferential overrun prevention means of FIG. 1.
Figure 6B:
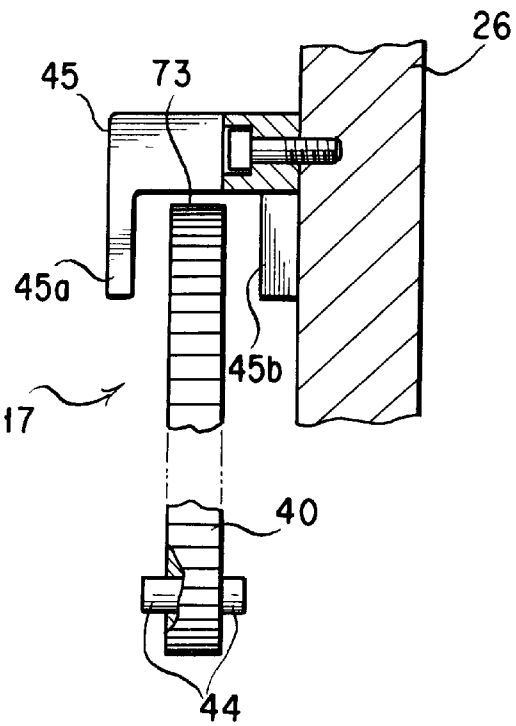
Figure 6C:
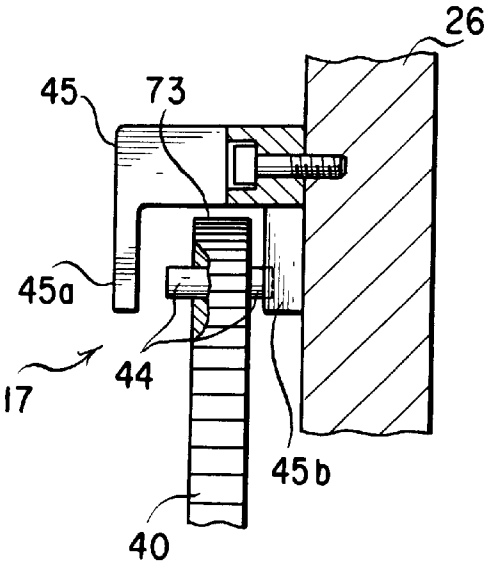

The circumferential overrun prevention means 17 are shown in FIGS. 1 and 2 and on an enlarged scale in FIGS. 6A–6C. A double ended pin 44 extends eccentrically through the driven gear 40 of the circumferential adjustment 15, providing a pair of projections on both sides of the driven gear. For engaging with the double ended pin 44 a limit stop member 45 is fastened to the subframe wall 26. U-shaped as seen in FIGS. 6A–6C, the limit stop member 45 provides a pair of limit stops 45*a* and 45*b* which are spaced from each other in a direction parallel to the axis of the driven gear 40.

The driven gear 40 laterally travels back and forth on being driven bidirectionally by the circumferential drive motor 43. One end of the pin 44 on the driven gear 40 is to come into abutment against one limit stop 45*a*, as in FIG. 6A, when the driven gear is driven in one direction in excess of a prescribed limit. The other end of the pin 44 is to come into abutment against the other limit stop 45*b*, as in FIG. 6C, when the driven gear is driven in the other direction in excess of a prescribed limit.

Operation

The operation of the right hand image registration means 4 will be described in regard first to the lateral adjustment 14, together with the lateral overrun prevention means 16, and then to the circumferential adjustment 15 together with the circumferential overrun prevention means 17. The operation of the left hand image registration means 4' is considered self evident from the operational description of the right hand image registration means 4.

For purposes of explanation, it will be assumed that the lateral drive motor 31 rotates counterclockwise, as viewed in FIG. 4, in response to stepping pulses and a stepping direction signal from the unshown control electronics. Driven by the drive pinion 30, the gear 28 will rotate clockwise with the threaded rod 25. It is understood that the screw thread on this rod 25 is right handed. Consequently, turned clockwise, the rod 25 will travel to the left, as viewed in FIG. 1, because of its engagement with the internally threaded member 27 on the subframe wall 26.

Since the threaded rod 25 has its left hand end, as seen in FIG. 1, coupled to the plate cylinder shaft extension 3 via the bearing 24, only the lateral motion of the threaded rod will be transmitted to the shaft extension. The result will be the leftward lateral travel of the right hand plate cylinder half 5.

In the practice of the instant invention the maximum allowable lateral displacement of the plate cylinder half 5 may be from about four to about six millimeters for proper registration of all the multicolor images. The pitch of the threaded rod 25, and of course that of the internally threaded member 27, should be so determined that the plate cylinder half 5 is laterally displaced a preselected distance within this range in response to the rotation of the driven gear 28 through a preselected angle not exceeding 360 degrees.

With that normally allowed angle of rotation of the driven gear 28 in mind, let us proceed now to the operational description of the lateral overrun prevention means 16. The pin 32 on the driven gear 28 is normally angularly spaced as aforesaid 180 degrees from the limit stop 33 on the subframe wall 26. As long as the lateral drive motor 31 is operating normally, the pin 32 will not engage the limit stop 33 even when turned the maximum allowable angle in either direction from its normal position 32*a*.

If the lateral drive motor 31 remains in counterclockwise rotation too long because of some control trouble or motor malfunctioning, the driven gear 28 will rotate clockwise in excess of its normally allowed angle until, after about 180 degrees of rotation, the pin 32 on the driven gear comes into abutment against one side of the limit stop 33, as pictured in FIG. 5A. The lateral drive motor 31 will then come to a standstill. Neither this motor nor any other parts or components of the press are to be ruined by such forced stop of the motor.

In the event of prolonged clockwise rotation of the lateral drive motor 31, on the other hand, the driven gear 28 will rotate counterclockwise until the pin 32 thereon comes into abutment against the other side of the limit stop 33, as in FIG. 5B. Although the driven gear 28 will travel laterally away from the subframe wall 26 in this case, the pin 32 will nevertheless engage the limit stop 33 because the dimensions of the pin and the abutment in a direction parallel to the driven gear axis are determined in relation to each other in consideration of the lateral displacement of the driven gear.

The circumferential drive motor 43 may be set in rotation in a required direction for circumferential positioning of the right hand plate cylinder half 5. Driven through the drive pinion 42, the driven gear 40 will rotate with the internally threaded member 39 coaxially secured thereto and so travel laterally of the threaded rod 25. The bearing 38 will convey only the lateral travel of the driven gear 40 to the bearing housing 37 and thence to the outer sleeve 36. The outer sleeve 36 will then travel laterally with the helical gear 10 thereon in sliding engagement with the helical gear 11 on the blanket cylinder shaft 8, thereby undergoing angular displacement. Although, here again, the outer sleeve moves both laterally and circumferentially, it is only the circumferential motion that will be transmitted via the intermeshing spur gears 34 and 35 to the plate cylinder shaft extension 3 and thence to the right hand plate cylinder half 5.

The amount of lateral displacement of the driven gear 40 for a desired amount of circumferential displacement of the right hand plate cylinder half 5 may be from about twelve to about eighteen millimeters. The amount of angular displacement of the driven gear 40 for such desired lateral displacement may be more than two, and less than three, complete revolutions. The circumferential overrun prevention means 17 function to prevent the rotation of the driven gear 40 in excess of the preset limits.

FIG. 6B shows the driven gear 40 in its normal lateral position, in which the gear is equidistantly spaced from the pair of limit stops 45*a* and 45*b*. The double-ended pin 44 on the driven gear 40 is also shown in this figure in its normal angular position, in which the pin is angularly spaced about 540 degrees, one and a half revolutions, from both limit stops 45*a* and 45*b*. The pin 44 will contact neither limit stops as long as the circumferential drive motor 43 is operating normally.

If the circumferential drive motor 43 continues rotation in a counterclockwise direction, as viewed in FIG. 4, beyond a limit of angular displacement of the right hand plate cylinder half 5 for some trouble or other, then the driven gear 40 will turn clockwise and travel laterally toward the plate cylinder. The rotation of the driven gear 40 will be arrested after one and a half revolutions from its normal position, as then one end of the pin 44 comes into abutment against the limit stop 45*a* as in FIG. 6A.

In the event of continued clockwise rotation of the circumferential drive motor 43, on the other hand, the driven gear 40 will turn counterclockwise and travel laterally toward the subframe wall 26. In this case, too, the driven gear 40 will stop after one and a half revolutions from its normal position, when the other end of the pin 44 comes into abutment against the other limit stop 45*b* as in FIG. 6C.

Although the image register control device according to the present invention has been shown and described hereinbefore in terms of one specific embodiment thereof, it is not desired that the invention be limited by the exact details of this embodiment. It is also understood that the invention is applicable to plate cylinders that are not split into halves. A combination of one lateral, and one circumferential, adjustment may be provided only at one end of such an unsplit plate cylinder. A variety of other modifications, alterations, and adaptations of the invention will suggest themselves to one skilled in the art without departing from the scope of the claims attached hereto.

What is claimed is:

1. An apparatus for fine positional adjustment of a plate cylinder in both lateral and circumferential directions thereof for image registration of a multicolor rotary printing press, the apparatus comprising:

(a) a plate cylinder;

(b) frame means for supporting the plate cylinder for both lateral and circumferential displacement;

(c) lateral adjustment means acting between the plate cylinder and the frame means for positional adjustment of the plate cylinder in a lateral direction thereof relative to the frame means, the lateral adjustment means including a first rotary member to be driven bidirectionally relative to the frame means for the lateral positional adjustment of the plate cylinder;

(d) lateral overrun prevention means for limiting the bidirectional rotation of the first rotary member of the lateral adjustment means relative to the frame means in order to prevent the plate cylinder from being driven laterally beyond limits;

(e) circumferential adjustment means acting between the plate cylinder and the frame means for positional adjustment of the plate cylinder in a circumferential direction thereof, the circumferential adjustment means including a second rotary member to be driven bidirectionally relative to the frame means for the circumferential positional adjustment of the plate cylinder; and (f) circumferential overrun prevention means for limiting the bidirectional rotation of the second rotary member of the circumferential adjustment means relative to the frame means in order to prevent the plate cylinder from being driven circumferentially beyond limits.

2. The apparatus of claim 1 wherein the lateral overrun prevention means comprises:

(a) a limit stop formed on the frame means; and (b) a projection formed eccentrically on the first rotary member of the lateral adjustment means for movement into abutment against the limit stop with the rotation of the first rotary member.

3. The apparatus of claim 2 wherein the projection on the first rotary member is normally angularly spaced approximately 180 degrees from the limit stop on the frame means for movement, with the bidirectional rotation of the first rotary member, into possible abutment against opposite sides of the limit stop.

4. The apparatus of claim 1 wherein the circumferential overrun prevention means comprises:

(a) limit stop means formed on the frame means; and (b) projection means formed eccentrically on the second rotary member of the circumferential adjustment means for movement into abutment against the limit stop means with the rotation of the second rotary member.

5. The apparatus of claim 4 wherein the second rotary member of the circumferential adjustment means travels back and forth laterally thereof relative to the frame means on being driven bidirectionally, wherein the limit stop means of the circumferential overrun prevention means comprises a pair of limit stops spaced from each other laterally of the second rotary member, and wherein the projection means of the circumferential overrun prevention means comprises a pair of projections formed on opposite sides of the second rotary member for movement, with the combined bidirectional rotary and lateral motion of the second rotary member, into abutment against the respective limit stops.

6. The apparatus of claim 1 wherein the lateral adjustment means includes first drive means for bidirectionally driving the first rotary member with a preadjusted force, and wherein the circumferential adjustment means includes second drive means for bidirectionally driving the second rotary member with a preadjusted force.

7. The apparatus of claim 6 wherein the first drive means includes a stepper motor, and wherein the second drive means includes another stepper motor.

8. An apparatus for fine positional adjustment of a plate cylinder in both lateral and circumferential directions thereof for image registration of a multicolor rotary printing press, the apparatus comprising:

(a) a plate cylinder having a shaft;

(b) frame means for supporting the shaft of the plate cylinder for both lateral and circumferential displacement;

(c) a screw-threaded rod screw-threadedly engaged with the frame means for laterally traveling back and forth on being rotated bidirectionally, the screw-threaded rod being coaxially and rotatably coupled to the shaft of the plate cylinder while being locked against lateral displacement relative to the same;

(d) a first rotary member rigidly and coaxially mounted to the screw-threaded rod for joint bidirectional rotation and lateral travel therewith;

(e) lateral drive means mounted to the frame means and coupled to the first rotary member for bidirectionally rotating the same in order to cause bidirectional lateral displacement of the plate cylinder relative to the frame means via the screw-threaded rod;

(f) lateral overrun prevention means for limiting the bidirectional rotation of the first rotary member relative to the frame means in order to prevent the plate cylinder from being driven laterally beyond limits;

(g) a sleeve coaxially mounted on the shaft of the plate cylinder for joint rotation therewith while being movable laterally relative to the plate cylinder shaft;

(h) helical gear means for translating the lateral travel of the sleeve into rotation thereof with the plate cylinder shaft;

(i) a second rotary member screw-threadedly engaged with the screw-threaded rod for laterally traveling back and forth relative to the same on being rotated bidirectionally, the second rotary member being coaxially and rotatably coupled to the sleeve while being constrained to joint lateral travel therewith;

(j) circumferential drive means mounted to the frame means and coupled to the second rotary member for bidirectionally rotating the same in order to cause circumferential displacement of the plate cylinder; and (k) circumferential overrun prevention means for limiting the bidirectional rotation of the second rotary member of the circumferential adjustment means relative to the frame means in order to prevent the plate cylinder from being driven circumferentially beyond limits.

9. The apparatus of claim 8 wherein the first rotary member is a driven gear in mesh with a drive pinion included in the lateral drive means, and wherein the lateral overrun prevention means comprises:

(a) a limit stop formed on the frame means; and (b) a projection formed eccentrically on the driven gear for movement into abutment against opposite sides of the limit stop with the bidirectional rotation of the driven gear.

10. The apparatus of claim 9 wherein the projection on the driven gear is normally angularly spaced approximately 180 degrees from the limit stop.

11. The apparatus of claim 8 wherein the second rotary member is a driven gear in mesh with a drive pinion included in the circumferential drive means, and wherein the circumferential overrun prevention means comprises:

(a) a pair of limit stops formed on the frame means and spaced from each other laterally of the driven gear; and (b) a double-ended pin affixed eccentrically to the driven gear and projecting in opposite lateral directions therefrom for movement, with the combined bidirectional rotary and lateral motion of the driven gear, into abutment one against each limit stop.

12. The apparatus of claim 11 wherein the double-ended pin on the driven gear is normally angularly spaced approximately 540 degrees from both limit stops.

* * * * *

UNITED STATES PATENT AND TRADEMARK OFFICE

CERTIFICATE OF CORRECTION

PATENT NO. : 6,655,278 B2
DATED : December 2, 2003
INVENTOR(S) : Takanobu Kawabata It is certified that error appears in the above-identified patent and that said Letters Patent is hereby corrected as shown below:

Title page,
Item [30], Foreign Application Priority Data, the data should read:
-- [30] June 7, 2000 (JP) ……...2000-170354 --

Signed and Sealed this

Twenty-fourth Day of February, 2004

JON W. DUDAS
*Acting Director of the United States Patent and Trademark Office*